United States Patent [19]

Hattori et al.

[11] 4,439,708

[45] Mar. 27, 1984

[54] SPARK PLUG HAVING DUAL GAPS

[75] Inventors: Tadashi Hattori, Okazaki; Hiroaki Yamaguchi, Anjo; Minoru Nishida; Minoru Ohta, both of Okazaki, all of Japan

[73] Assignee: Nippon Soken, Inc., Nishio, Japan

[21] Appl. No.: 257,134

[22] Filed: Apr. 24, 1981

[30] Foreign Application Priority Data

May 30, 1980 [JP] Japan ..... 55-73262
May 30, 1980 [JP] Japan ..... 55-73263

[51] Int. Cl.[3] ..... H01T 13/20
[52] U.S. Cl. ..... 313/140; 313/142
[58] Field of Search ..... 313/140, 141, 130, 123, 313/131 R, 131 A, 142

[56] References Cited

U.S. PATENT DOCUMENTS 2,900,547 8/1959 Engel ..... 313/130
3,854,067 12/1974 Morgan ..... 313/130
3,872,338 3/1975 Wax ..... 313/130

*Primary Examiner*—Palmer C. Demeo
*Assistant Examiner*—Sandra L. O'Shea
*Attorney, Agent, or Firm*—Cushman, Darby & Cushman

[57] ABSTRACT

A spark plug includes a body of dielectric substance mounted on one of central and earth electrodes and having polarization effects. A gap for capacitive discharge is defined between the body of dielectric substance and the other of the electrodes, and a gap for inductive discharge is defined between the electrodes, which gap for inductive discharge is larger in dimension than the gap for capacitive discharge. With the arrangement, capacitive discharge to be produced in the early stage of discharge is caused at low discharge breakdown voltage due to polarization effects of the body of dielectric substance, and inductive discharge taking the main part of discharge for ignition is produced by utilizing the capacitive discharge of low voltage as trigger, thereby lowering discharge breakdown voltage to improve ignition performance of the spark plug.

17 Claims, 16 Drawing Figures

SPARK PLUG HAVING DUAL GAPS

BACKGROUND OF THE INVENTION

This invention relates to spark plugs having dual gaps and polarization effects of dielectric, and more particularly to spark plugs in which such polarization effects take place between an end of a central electrode and earth electrode to improve discharge performance.

In recent years, such aspects as regulation of exhaust gas and improvement of fuel consumption rate have induced combustion in internal combustion engines to be effected under conditions which utilize lean fuel mixtures and high compression rate. Lean fuel mixtures and high compression rate are causes for worsening ignition of the fuel-air mixture. In this regard, spark plugs have been increasingly required to be improved in their ignition performance. Usually, it is well-known that ignition performance can be greatly improved by enlargement of discharge gaps. However, pressure rise in combustion chambers, in particular, pressure rise accompanying such high compression rate causes rise of discharge breakdown voltage, so that it is inconsistent with conventional ignition systems in terms of technical levels and cost, thus giving rise to a problem in not enabling enlarging gaps beyond some limits. Even if discharge gaps could be enlarged, there would remain a problem in which consumption of electrodes accompanies ignition systems of high energy.

SUMMARY OF THE INVENTION

It is an object of this invention to provide a spark plug in which a coating of a dielectric substance is provided at an end of a central electrode on the side thereof facing an earth electrode such that a capacitive discharge gap is defined between the coating and the earth electrode and an inductive discharge gap larger than the capacitive discharge gap is defined between the earth electrode and that portion of the central electrode which is not covered by the coating, thereby causing capacitive discharge produced in the early stage of discharge to be effected at low discharge breakdown voltage due to polarization effects of the coating of a dielectric substance and causing inductive discharge taking the main part of discharge for ignition to be effected by utilizing the capacitive discharge of low voltage as trigger with the result that discharge breakdown voltage can be reduced to improve ignition performance.

It is a further object of this invention to provide a spark plug in which a protuberant, secondary electrode formed of a ring-shaped or cup-shaped dielectric substance is provided on an end of an earth electrode facing a central electrode, and a capacitive discharge gap is defined between the secondary electrode and the end of the central electrode, and an inductive discharge gap dimensionally larger than the capacitive discharge gap is defined between the end of the central electrode and the earth electrode, so that capacitive discharge produced in the early stage of discharge is caused at low discharge breakdown voltage due to polarization effects of the dielectric substance and inductive discharge taking the main part of discharge for ignition is caused by utilizing the capacitive discharge of low voltage as trigger, thereby lowering the discharge breakdown voltage to improve ignition performance.

BRIEF DESCRIPTION OF THE DRAWINGS

The features of the present invention are set forth with particularity in the appended claims. The invention will be described in detail in the following description of preferred embodiments taken in conjunction with the accompanying drawings in the several figures of which like reference numerals identify like elements and in which;

DESCRIPTION OF THE PREFERRED EMBODIMENT

Figure 1:
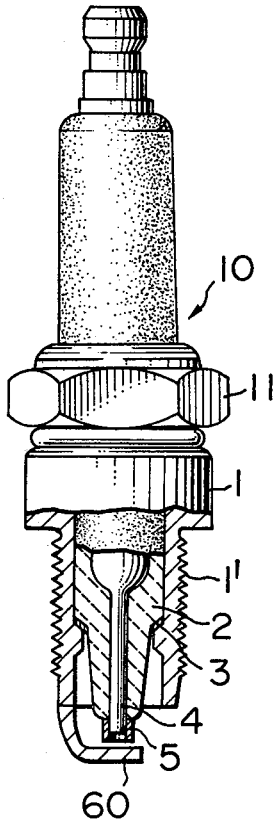
FIG. 1 is a fragmentary, side elevational view of a spark plug according to a first embodiment of the invention.
Figure 2:
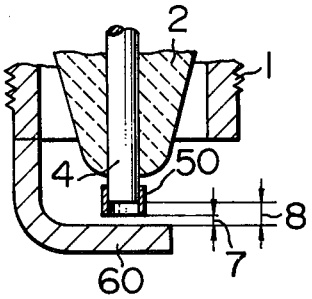
FIG. 2 is an enlarged view of a part of the spark plug of FIG. 1.

Referring now to FIGS. 1 and 2, reference numeral 10 generally designates a spark plug which includes a metal shell or shank 1 having a threaded portion 1*a* and a hexagonal nut 11, an insulator 2 of alumina mounted securely in the shank 1 by a packing 3, and a central electrode 4. A ring-shaped member 5 formed of $TiO_2$ is bonded by an adhesive to the central electrode end protruding toward a combustion chamber. The end of the ring-shaped member 5 extends beyond the endface of the central electrode 4 toward an earth electrode 60 to form therebetween a gap 7 for capacitive discharge. A gap 8 for inductive discharge is defined between the end surface of the central electrode 4 and the earth electrode 60, and is widened for better ignition of the fuel-air mixture.

In operation, high voltage electrical charge is impressed across the electrodes 4 and 60 to create electric field at the capacitive discharge gap 7. As a result, polarization effect is produced at the ring-shaped member 5 formed of dielectric material, so that electric charge is concentrated on the side surfaces of the earth electrode 60. Due to such concentration of electric charge and small dimension of the capacitive discharge gap 7, capacitive discharge is produced at low electric voltage. Electric charge such as ion from such capacitive discharge acts as trigger for inductive discharge, so that inductive discharge having a good amount of energy is started at the larger gap, that is, the inductive discharge gap 8 for better ignition of the fuel-air mixture while rubbing the inner wall of the ring-shaped member 5. Electric current is rendered small due to the large resistance of the ring-shaped member 5 to permit induced current to flow primarily at the inductive discharge gap 8. As a sufficient amount of ion required for starting electric discharge is existing prior to the induced discharge, electric voltage for discharge at the large gap 8 is greatly reduced to thereby attain better ignition of the fuel-air mixture and reduction of discharge breakdown voltage. Furthermore, according to this embodiment, there is provided a space surrounded by the inner wall surface of the ring-shaped member 5 and the end surface of the central electrode 4, so that flame is subject to little cooling effect which would cause trouble at the early stage of combustion, and is hard to be blown out by rapid stream of the fuel-air mixture, thus ensuring stable combustion and ignition of the mixture. It was ascertained that when the prior spark plug and the spark plug according to this embodiment of the present invention with the dielectric material being $TiO_2$ were compared with each other in relation to discharge breakdown voltage, reduction of electric voltage ranging from 1 to 5 KV was obtained within the range of 1 to 8 $Kg/cm^2$ of the fuel-air mixture with the prior spark plug having a gap of 1.25 mm and the present spark gap having a gap 7 of 0.75 mm and a gap 8 of 1.25 mm.

Figure 3A:
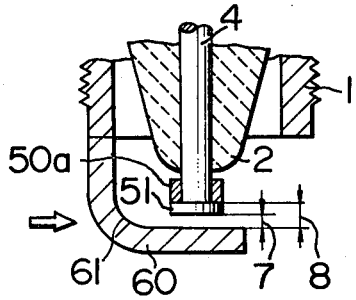
FIG. 3A is a fragmentary view of a part of a spark plug according to a second embodiment of the invention.
Figure 3B:
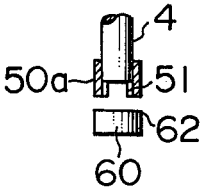
FIG. 3B is a side elevational view of the spark plug of FIG. 3A.

FIGS. 3A and 3B show a second embodiment of the present invention in which the ring-shaped member 5 shown in FIG. 2 is formed at its end facing the earth electrode 60 with a slit 51 paralleling the same. This slit 51 is intended for prescribing a location where electric discharge is started. Ignition performance in spark plugs is varied depending on the speed and direction of flow of the fuel-air mixture. Ignition performance is most unfavorable in the arrow direction of FIG. 3A from the rearward of the earth electrode 60 toward the central electrode 4. In conventional spark plugs, electric discharge tends to occur most between the central electrode 4 and the bent portion 61 of the earth electrode 60, thus worsening the ignition performance. The provision of the slit 51 according to the second embodiment of the present invention causes electric discharge between the end of the earth electrode 60 and the end of the ring-shaped member 50*a*, thus improving the ignition performance in relation to the direction as described above.

Figure 4:
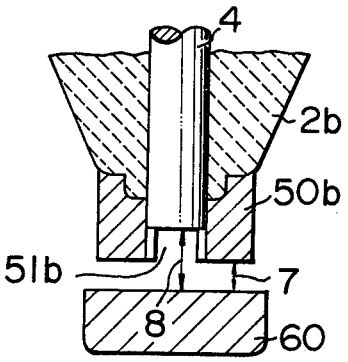
FIG. 4 is a fragmentary view of a part of a spark plug according to a third embodiment of the invention.

FIG. 4 shows a third embodiment of the present invention, in which the ring-shaped member 50*b* is beforehand united with the insulator 2*b* as by bonding or baking for the purpose of strengthening the rigidity of the member. In this case, a slit 51*b* is formed on the ring-shaped member 50*b* to prescribe a location of electric discharge for improvement of ignition performance.

Figure 5:
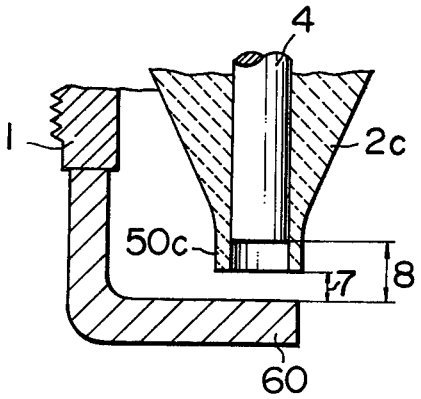
FIG. 5 is a fragmentary view of a part of a spark plug according to a fourth embodiment of the invention.

FIG. 5 shows a fourth embodiment of the present invention, in which the ring-shaped member 50*c* is integrally formed on the insulator 2*c* which is conventionally made of alumina, so that such integral construction enables increasing the strength of the member 50*c* and reducing the manufacturing cost of the same. A dielectric constant of a dielectric substance is generally determined by a material as used. In this case, other dielectric substances are beforehand mixed with alumina. In this embodiment, the ring-shaped member 50*c* may be formed with a slit.

Figure 6:
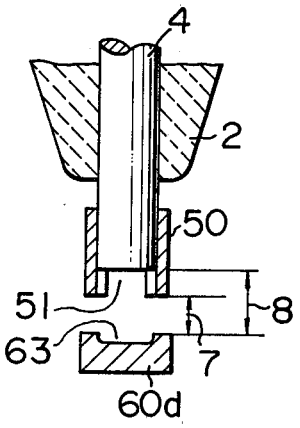
FIG. 6 is a fragmentary sectional view of a part of a spark plug in the modified form of the embodiment of FIG. 3.

FIG. 6 shows a modification of the embodiment of FIG. 3A, in which the earth electrode 60*d* is formed with a groove 63 to more closely limit a location where electric discharge is started, thereby improving the ignition performance.

Figure 7:
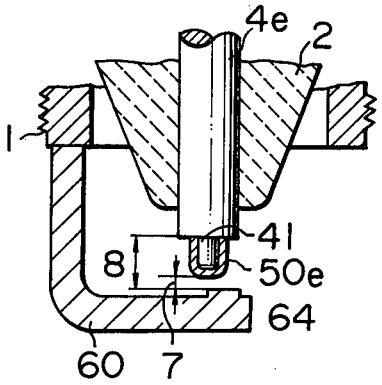
FIG. 7 is a fragmentary sectional view of a part of a spark plug according to a fifth embodiment of the invention.

FIG. 7 shows a fifth embodiment of the present invention, in which the central electrode 4*e* is provided with a projection 41, and a cup 51*e* formed of dielectric substance is secured to the projection 4' as by bonding or baking. The earth electrode 60 is provided at its end portion with a projection 64 opposite to the central electrode 4*e*. In this embodiment, the provision of the small and large gaps 7, 8 achieves reduction of discharge breakdown voltage, in the same manner as in the embodiments described above. Due to the existence of the projection 64 on the earth electrode 60, electric discharge is primarily started at the end portion of the earth electrode 60 which is not so much influenced by the direction of flow of the fuel-air mixture, thus improving the ignition performance. In addition, the growth of combustion produces conditions under which heat is hard to abate, thus achieving more stable growth of combustion.

In the respective embodiments, the ring-shaped member or cup 50*e* is formed of $TiO_2$ having a high dielectric constant, and may be formed of any dielectric substance such as $Al_2O_3$, $CrO_2$, CoO, $V_2O_2$, $Nb_2O_3$, MnO, and $TiN+Al_2O_3$. When the ring-shaped member or cup 50*e* is formed using metals having a relatively large value of resistance, the relationship between value of resistance and a discharge holding voltage simply produces results in which reduction of the voltage required for starting electric discharge can be expected corresponding to a reduction in the value of resistance.

Figure 8:
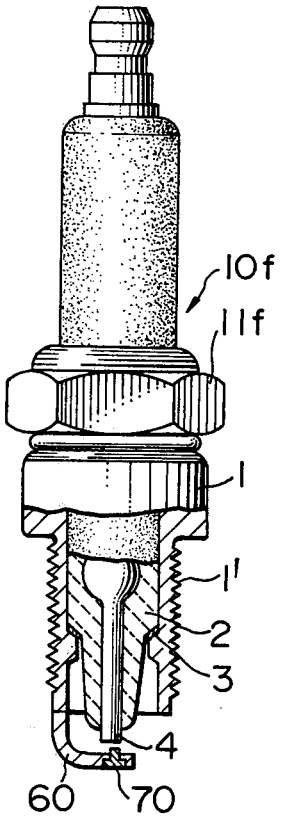
FIG. 8 is a fragmentary, side elevational view of a spark plug according to a sixth embodiment of the invention.
Figure 9:
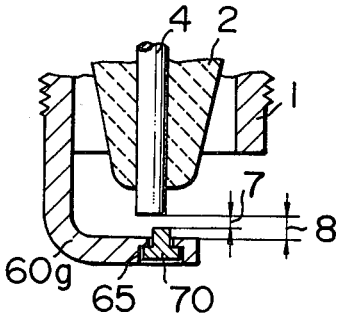
FIG. 9 is an enlarged view of a part of the spark plug of FIG. 8.

Referring now to FIGS. 8 and 9, a spark plug 10*f* according to a sixth embodiment of the present invention includes a metallic shell or shank 1 having a threaded portion 1' and a hexagonal nut 11*f*, an insulator 2 of alumina mounted securely in the shank 1 by a packing 3, and a central electrode 4. Reference numeral 60 designates an earth electrode secured to the end of the metallic shell 1 and opposed to the central electrode 4. A secondary electrode 70 having a columnar outer shape and a closed-packed construction of a dielectric substance is provided at the end of the earth electrode 60 in opposed relation to the central electrode 4. The secondary electrode 70 has a narrower diameter than the width of the earth electrode 60, and is secured in a bore 65 formed in the earth electrode 60 by means of a conductive ceramic. A gap 7 for capacitive discharge is defined between the the secondary electrode 70 and the central electrode 4, and a gap 8 for inductive discharge is provided between the earth electrode 60 and the central electrode 4 which gap 8 is larger in dimension than the gap 7.

In operation, ignition-inducing high voltage is impressed across the electrodes 4 and 60 to create electric field at the capacitive discharge gap 7. As a result, polarization effect is produced at the secondary electrode 70 formed of a dielectric substance, so that electric charge is concentrated on the side surfaces of the earth electrode 70. Due to such concentration of electric charge and small dimension of the capacitive discharge gap 7, capacitive discharge is produced at low discharge voltage. Thereafter electric charge such as ion from such capacitive discharge acts as trigger for inductive discharge, so that inductive discharge having a good amount of energy is started at the larger gap, that is, the inductive discharge gap 8 for better ignition of the fuel-air mixture while rubbing the outer wall of the secondary electrode 60. At this point of time, electric current is made at low level due to the large value of resistance of the secondary electrode 70 to permit induced current to flow primarily at the inductive discharge gap 8. As a sufficient amount of ion required for starting electric discharge is existing prior to the occurrence of the induced discharge, the electric voltage for starting discharge at the large gap 8 is greatly reduced to thereby attain better ignition of the fuel-air mixture and reduction of discharge breakdown voltage.

Figure 15:
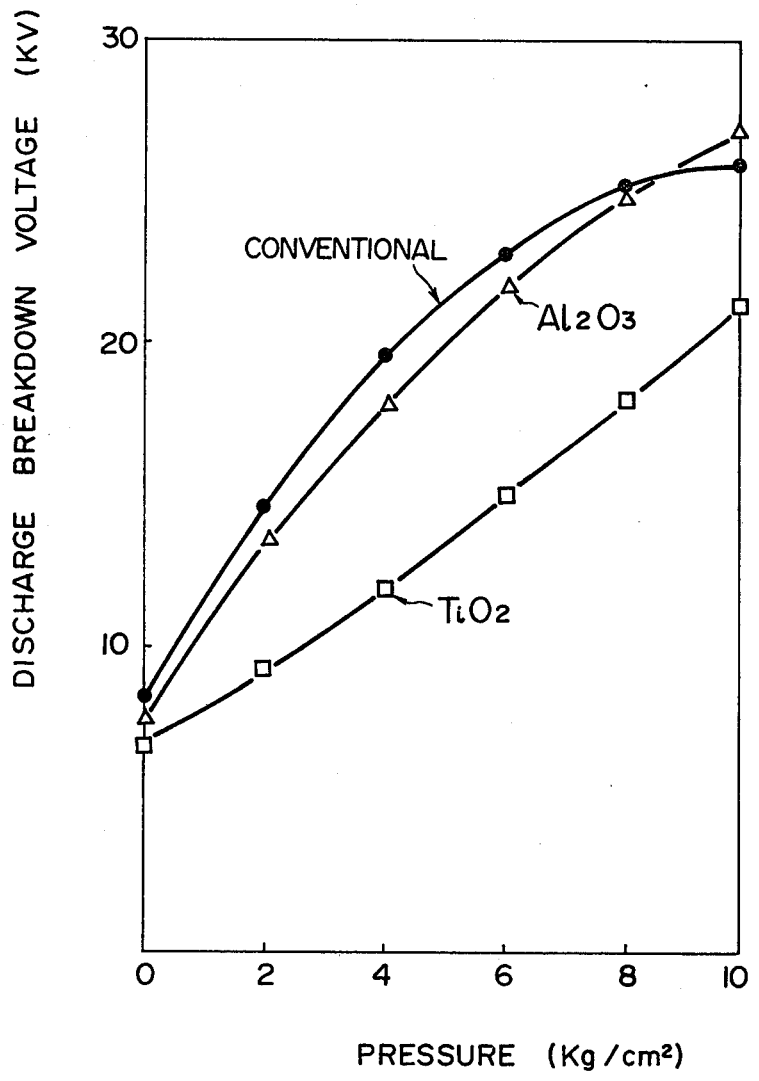
FIG. 15 shows a graph illustrating characteristics of the spark plug of the invention in comparison with the prior art.

FIG. 15 shows a experimental result in which a prior spark plug having a gap of 1.25 mm and the present spark plug of the above embodiment having a gap 7 of 0.75 mm and a gap 8 of 1.25 mm were compared to each other in relation to discharge breakdown voltage. In the experiment, electric discharge was produced two thousand times, of which maximum discharge breakdown voltage is shown in FIG. 15. As seen from FIG. 15, discharge breakdown voltage is generally low as compared with the prior art when the secondary electrode 70 is formed of $Al_2O_3$ and $TiO_2$ in particular only of $TiO_2$.

Figure 10:
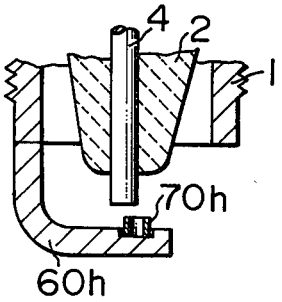
FIG. 10 is a fragmentary sectional view of a part of a spark plug according to a seventh embodiment of the invention.

FIG. 10 shows a seventh embodiment of the present invention, in which the secondary electrode **70*h* is ring-shaped instead of the columnar shape in FIG. 9, and has a side portion thereof aligned with the axis of the central electrode 4**. According to this embodiment, flame is not so much subject to cooling effect at the early stage of ignition, and is hardly extinguished by rapid stream of the fuel-air mixture.

Figure 11:
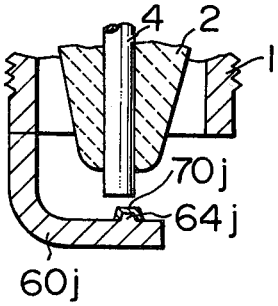
FIGS. 11 to 14 show various forms of spark plugs, in fragmentary side elevational views, according to the invention.

FIG. 11 shows a secondary electrode **70*j* which is mounted on a frustoconical-shaped projection 64*j* of the earth electrode 60*j* by covering the same with a thin closed-packed coating of a dielectric substance by the spattering method. In this case, the earth electrode 60*j*** acts as a rear electrode more effectively, as compared with the embodiment, to bring about reduction in discharge breakdown voltage.

Figure 12:
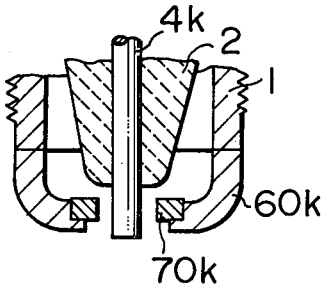

FIG. 12 shows secondary electrodes **70*k* in the form of a tube having a circular or square shaped opening which is made of a dielectric substance and is secured to the ends of the earth electrodes 60*k* facing the sides of the central electrode 4*k*. With this arrangement, electric discharge is not so much influenced by the direction of the flow of the fuel-air mixture since discharge is effected rather above the lower ends of the earth electrodes 60*k*. The secondary electrode 70*k* is of the same width as the earth electrodes 60*k***.

Figure 13:
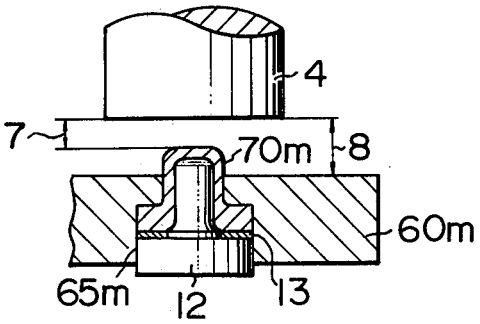

FIG. 13 shows a further embodiment of the present invention, in which the earth electrode **60*m* is formed with a stepped bore 65*m*. A secondary electrode 70*m* having a cup-like shape and formed of a dielectric substance such as $TiO_2$ is fitted in the stepped bore 65*m*, and a convex-shaped support 12 formed of the same material (for example, Ni-Cr) as that of the earth electrode 60*m* is driven into the secondary electrode 70*m* such that a spacer 13 formed of a soft, heat-resisting material such as Ni is interposed therebetween. After being driven in the manner as described above, the support 12 is secured to the earth electrode 60*m*** as by welding.

Figure 14:
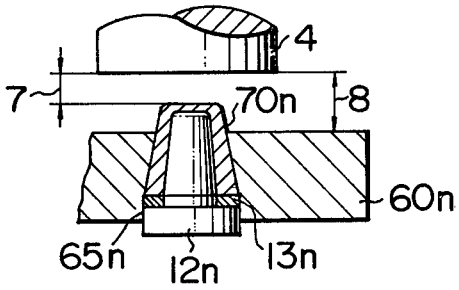

FIG. 14 shows a modification of the embodiment as shown in FIG. 13. In FIG. 14, the secondary electrode **70*n* and the support 12*n***, respectively, are tapered at their inner or outer surface to ensure securement thereof.

In the respective embodiments as described above, the secondary electrode (**70–70*n***) is formed of $TiO_2$ having a high dielectric constant. However, the electrode may be formed of other dielectric substances such as $Al_2O_3$, $CrO_2$, CoO, $V_2O_3$, $Nb_2O_3$, MnO and TiN+$Al_2O_3$.

As described above, according to the present invention, a coating of a dielectric substance is provided at the end of the central electrode on the side thereof facing the earth electrode so that a capacitive discharge gap is produced between the coating and the earth electrode, and an inductive discharge gap is produced between the earth electrode and the portion of the central electrode not covered by the coating. As the inductive dischage gap is larger than the capacitive discharge gap, capacitive discharge produced in the early stage of discharge is caused at low breakdown voltage based on a polarization effect of the coating of a electric substance, and inductive discharge for ignition at the inductive discharge gap is caused by the capacitive discharge of low voltage being a trigger therefor, thereby enabling reducing discharge breakdown voltage. Thus ignition performance can be improved without raising discharge breakdown voltage.

It is intended that the foregoing be merely a description of a preferred embodiments and that the invention be limited solely by that which is within the scope of the appended claims.

What is claimed is:

1. In a spark plug for use with internal combustion engines including a central electrode supported by an insulator and having a substantially rod-like shape, a metallic shell surrounding and secured to said insulator, and an earth electrode mounted on said metallic shell in opposed relation to said central electrode, the improvement comprising a body of a dielectric substance mounted on one of said central and earth electrodes such that a first gap for capacitive discharge is defined between said body of the dielectric substance and the other of said both electrodes, and a second gap for inductive discharge is defined between said both electrodes, said second gap for inductive discharge being dimensionally larger than said first gap for capacitive discharge, said body of the dielectric substance having polarization effects which cause capacitive discharge.

2. A spark plug as set forth in claim 1 wherein said body comprises an enclosure of a dielectric substance provided at the end of said central electrode on the opposite side thereof to said earth electrode to define a gap for capacitive discharge between said enclosure and said earth electrode and to define a gap for inductive discharge between said earth electrode and that portion of said central electrode which is not covered by said enclosure.

3. A spark plug as set forth in claim 2 wherein said enclosure is in the form of a ring-shaped body made of $TiO_2$ which is secured by adhesives to the end of said central electrode extending toward the combustion chamber of the associated engine, and the end of said ring-shaped body extends beyond the end surface of said central electrode toward the earth electrode.

4. A spark plug as set forth in claim 3 wherein said ring-shaped body is formed at its end opposite to the earth electrode with a slit parallel thereto.

5. A spark plug as set forth in claim 3 wherein said ring-shaped body is beforehand integrally secured to said insulator by bonding or baking and is formed with a slit.

6. A spark plug as set forth in claim 3 wherein said ring-shaped body is integrally formed on said insulator, and is at its end opposite to the earth electrode with a slit parallel thereto.

7. A spark plug as set forth in claim 4 wherein said earth electrode is formed with a groove for limiting a location where electric discharge is started.

8. A spark plug as set forth in claim 2 wherein said enclosure is in the form of a cup-shaped member which is fitted on a projection formed on the end of said central electrode, and said earth electrode is formed at its end opposite to the central electrode with a projection.

9. A spark plug as set forth in claim 2 wherein said dielectric substance is one of $Al_2O_3$, $CrO_2$, CoO, $V_2O_3$, $Nb_2O_3$, MnO, and $TiN+Al_2O_3$.

10. In a spark plug for use with internal combustion engines including a central electrode supported by an insulator and having a substantially rod-like shape, a metallic shell surrounding and secured to said insulator, and an earth electrode, the improvement comprising an enclosure of a dielectric substance mounted on an end of said central electrode opposite to said earth electrode such that a gap for capacitive discharge is defined between said enclosure and said earth electrode, and a gap for inductive discharge is defined between said earth electrode and that portion of said central electrode which is not covered by said enclosure, said gap for inductive discharge having a larger width than that of said gap for capacitive discharge.

11. In a spark plug for use with internal combustion engines including a central electrode supported by an insulator, a metallic shell surrounding and secured to said insulator, and an earth electrode on said metallic shell in opposed relation to an end of said central electrode, the improvement comprising a projection-shaped secondary electrode formed mainly of a dielectric substance and provided at an end of said earth electrode on the opposite side thereof to said central electrode in such a manner that a gap for capacitive discharge is defined between said secondary electrode and the end of said central electrode, and a gap for inductive discharge is defined between the end of said earth electrode and the end of said central electrode, said gap for inductive discharge having a larger width than that of said gap for capacitive discharge.

12. A spark plug as set forth in claim 11 wherein said secondary electrode has a conductive material therein and is covered by a dielectric substance.

13. A spark plug as set forth in claim 11 wherein said secondary electrode is in the form of a column, and is secured to said earth electrode by means of a conductive ceramic.

14. A spark plug as set forth in claim 11 wherein said secondary electrode is ring-shaped, and has its side portion aligned with the axis of said central electrode.

15. A spark plug as set forth in claim 11 wherein said secondary electrode comprises a coating of a dielectric substance which is formed on a frustoconical-shaped projection provided on said earth electrode.

16. A spark plug as set forth in claim 11 wherein there are at least a pair of earth electrodes having their ends arranged to be opposed to the side of said central electrode, and the secondary electrode is secured to said ends and is in the form of a tube having a circular or a square shaped opening.

17. A spark plug as set forth in claim 11 wherein a stepped bore is formed in said earth electrode and fits thereinto said secondary electrode which is cup-shaped and is formed of a dielectric substance such as $TiO_2$.

* * * * *